US008714503B1

(12) United States Patent
Fadrow

(10) Patent No.: US 8,714,503 B1
(45) Date of Patent: May 6, 2014

(54) CONNECTOR FOR STABLY MOUNTING BOW-HUNTING QUIVERS TO A SUPPORT STRUCTURE

(76) Inventor: Dale Eugene Fadrow, Redgranite, WI (US)

( * ) Notice: Subject to any disclaimer, the term of this patent is extended or adjusted under 35 U.S.C. 154(b) by 530 days.

(21) Appl. No.: 12/956,583

(22) Filed: Nov. 30, 2010

Related U.S. Application Data

(60) Provisional application No. 61/283,477, filed on Dec. 4, 2009.

(51) Int. Cl.
*A47B 96/06* (2006.01)

(52) U.S. Cl.
USPC ..... 248/231.71; 248/229.15; 248/291.1; 124/86

(58) Field of Classification Search
USPC ..... 248/291.1, 292.11, 296.1, 229.15, 248/292.12, 299.1, 231.71; 124/41.1, 83
See application file for complete search history.

(56) References Cited

U.S. PATENT DOCUMENTS 757,257 A * 4/1904 Brown ..... 379/446
3,434,638 A * 3/1969 Beynon ..... 224/197
3,734,439 A * 5/1973 Wintz ..... 248/224.51
4,685,438 A * 8/1987 Larson ..... 124/25.7
5,193,725 A * 3/1993 Radocy ..... 224/197
6,817,499 B2 * 11/2004 Martinez ..... 224/197
7,464,908 B2 * 12/2008 Files ..... 248/229.16
7,987,842 B2 * 8/2011 McPherson ..... 124/86

OTHER PUBLICATIONS

Summer/Fall 2010 Mathews "Get Ahead of the Game" Catalog (selected pages in color).
2009 Fuse Accessories Product Guide (selected pages in color).

* cited by examiner

*Primary Examiner* — Gwendolyn W. Baxter
(74) *Attorney, Agent, or Firm* — Craig A. Fieschko, Esq.; DeWitt Ross & Stevens S.C.

(57) ABSTRACT

An exemplary quiver mount permits a user to stably mount various quivers to a tree stand. The quiver mount includes a mounting body having spaced mounting body flanges extending from a mounting body base and defining a mounting body valley sized to receive a tree stand limb. Threaded members extending into the mounting body valley engage the limb and help secure the mounting body to the tree stand. The mounting body base preferably includes pairs of equally-spaced quiver bracket mounting apertures (e.g., 1.3125 inches apart). Various quiver brackets that removably receive different quivers may be secured to the mounting body via the quiver bracket mounting apertures. A quiver bracket mount between the quiver bracket and the mounting body allows rotation of the quiver bracket without its removal and replacement. Quiver gripping arms extending from the mounting body form a quiver gripping mouth for removably securing differently-configured quivers.

20 Claims, 4 Drawing Sheets

CONNECTOR FOR STABLY MOUNTING BOW-HUNTING QUIVERS TO A SUPPORT STRUCTURE

CROSS-REFERENCE TO RELATED APPLICATIONS

This application claims priority under 35 USC §119(e) to U.S. Provisional Patent Application 61/283,477 filed Dec. 4, 2009, the entirety of which is incorporated by reference herein.

FIELD OF THE INVENTION

This document concerns an invention relating generally to bow-hunting accessories, and more specifically to a connector for stably mounting quivers having various configurations to a support structure like a tree stand.

BACKGROUND OF THE INVENTION

Bow hunters use archery skills to hunt game animals by using a bow to propel arrows toward a target animal. While hunting in the woods, the hunter might use a tree stand, which can be secured to a tree at various heights, to achieve an elevated position in the tree. Tree stands often use a metallic frame having limbs extending therefrom, with a metallic, wooden, or plastic platform to support the hunter. Hunters usually use quivers, which can have a great variety of configurations, to hold their arrows. While aiming a first arrow, the hunter often rests the quiver with spare arrows against a tree. Hunters also often install a hook in the bark of the tree, and hang their quiver on the hook.

These approaches suffer from many shortcomings. A quiver resting on a tree or hanging on a hook is not readily accessible to the hunter wishing to quickly retrieve an arrow. Such a quiver is also not rigidly secured, and the hunter often requires two hands to retrieve an arrow from the quiver, or great dexterity if using only one hand. Because of the difficulty of removing the arrow from the quiver, the hunter might generate more noise as he or she works to retrieve the arrow, potentially scaring away game animals. Also, the removal of arrows from unstably-secured quivers takes more time, and the additional seconds could result in missed opportunities. Once a first arrow is unsuccessfully propelled toward an animal, the arrow may scare off the animal. If the hunter wishes to fire a second arrow while the animal is still within range, he or she must act quickly. The hunter cannot afford to fumble with a loosely-secured quiver while attempting to retrieve another arrow for a second shot at the fleeing animal.

What is needed is a versatile quiver mount that rigidly secures a great variety of differently-configured quivers to a stable support structure such as a tree stand.

SUMMARY OF THE INVENTION

The invention, which is defined by the claims set forth at the end of this document, is directed to a versatile quiver mount that engages quivers to a tree stand or other support structure. A basic understanding of some of the features of preferred versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

An exemplary quiver mount 10 permits a user to stably mount various types of quivers to a tree stand. Referring initially to FIG. 1, the quiver mount 10 includes a mounting body 100 having a mounting body valley 140 sized to receive a limb 20 (see FIGS. 3A and 3B) of the tree stand. The mounting body 100 may include a mounting body base 110 with spaced mounting body flanges 120, 130 extending therefrom, with the mounting body valley 140 being defined between the mounting body flanges 120, 130. One or more threaded members 170 may extend through the mounting body 100 and into the mounting body valley 140 to engage the limb 20 and help secure the mounting body 100 to the tree stand. A quiver bracket 300 (such as 300A, 300B, or 300C) that can removably receive a quiver 3000 (see FIGS. 3A and 3B) may be secured to the mounting body 100.

The mounting body base 110 may include one or more quiver bracket mounting apertures 150 for securing the quiver bracket 300 to the mounting body base 110. The quiver bracket mounting apertures 150 are preferably arrayed along a circular path orbiting, and equidistant from, a central axis. The array of quiver bracket mounting apertures 150 may be defined in one or more pairs, with the quiver bracket mounting apertures 150 in each pair being spaced the same distance apart. This distance preferably corresponds with the standard aperture spacing used for mounting sights and/or quivers on bows. By spacing the quiver bracket mounting apertures 150 in each pair about 1 and 5/16 inches (or approximately 3.3 centimeters) apart, the mounting body 100 is able to accommodate any quiver bracket 300 designed to be engaged to this common spacing.

Referring to FIGS. 1, 2A and 2B, the mounting body 100 may include quiver gripping arms 200 for securing different types of quivers in different orientations. Each of first and second quiver gripping arms 210, 220 may have a differently-sized depression 230, 240 formed therein, with the depressions 230, 240 of the arms facing each other to define a quiver gripping mouth 250 for receiving a quiver 2000. The quiver gripping mouth 250 first converges and then diverges as the quiver gripping arms 200 extend toward the mounting body 100, helping the quiver gripping mouth 250 to complementarily receive a portion of quiver 2000 between quiver gripping arms 200. An axis extending from and bisecting the depression 240 of the second quiver gripping arm 220 may be oriented at an angle to an axis extending from and bisecting the depression 230 of the first quiver gripping arm 210 (preferably at an angle of at least 30 degrees), aiding installation/removal of the quiver from the quiver gripping arms 200, as further discussed below.

Referring to FIGS. 3A and 3B, the quiver bracket 300 may be directly secured to the mounting body base 110 via one or more of the quiver bracket mounting apertures 150, and the quiver bracket 300 may removably engage a quiver 3000 by complementarily receiving a portion 3010 of the quiver 3000. The quiver brackets 300A, 300C may include a quiver release lever 330A, 330C (see FIG. 1) movable between a closed position in which the quiver is secured to the quiver bracket 300A, 300C, respectively, and an open position in which the quiver is removable from the quiver bracket 300A, 300C.

Referring to FIGS. 4A, 4B, and 4C, a quiver bracket mount 400 situated between the quiver bracket 300 and the mounting body 100 allows the user to rotate the quiver bracket 300, and thus the quiver 3000 secured thereto, with respect to the mounting body 100. The quiver bracket 300 indirectly secured to the mounting body 100 via the quiver bracket mount 400 may be rotatable with respect to the central axis of the array of quiver bracket mounting apertures 150. The quiver bracket mount 400 may be elastically biased (using, e.g., a compressible spring 450) toward the mounting body 100 such that the quiver bracket mount 400 is translatable between a fixed position and a rotatable position with respect to the mounting body 100. In the fixed position (shown in FIG. 4C), the quiver bracket mount 400 is closely adjacent to, and non-rotatably fixed to, the mounting body base 110, with a pair of locking members 430 extending from the quiver bracket mount 400 into one of the pairs of quiver bracket mounting apertures 150. In the rotatable position, the locking members 430 of the quiver bracket mount 400 may be spaced from the mounting body base 110, and the quiver bracket mount 400 may be freely rotated about the central axis of the quiver bracket mounting apertures 150. To fix a new angle for the quiver bracket mount 400 following its rotation, the pair of locking members 430 of the quiver bracket mount 400 can be inserted within a different pair of quiver bracket mounting apertures 150.

By securing the mounting body 100 to a limb 20 of a tree stand secured to a tree, the quiver installed on the quiver mount 10 (via the quiver gripping arms 200 and/or via the quiver bracket mounting apertures 150) is rigidly mounted to a stable structure. This allows a bow hunter to quickly and efficiently retrieve an arrow from the quiver through fewer and smoother motions, using only one free hand. Limiting unnecessary motions means less noise is generated while hunting game and less time is taken to load and reload. Limiting noise and lowering the time taken to load and reload allows the bow hunter to better focus on locating game, aiming at targets, and shooting arrows, enhancing the bow hunter's success rate.

Further advantages and features of the invention will be apparent from the remainder of this document in conjunction with the associated drawings.

DETAILED DESCRIPTION OF PREFERRED VERSIONS OF THE INVENTION

Figure 1:
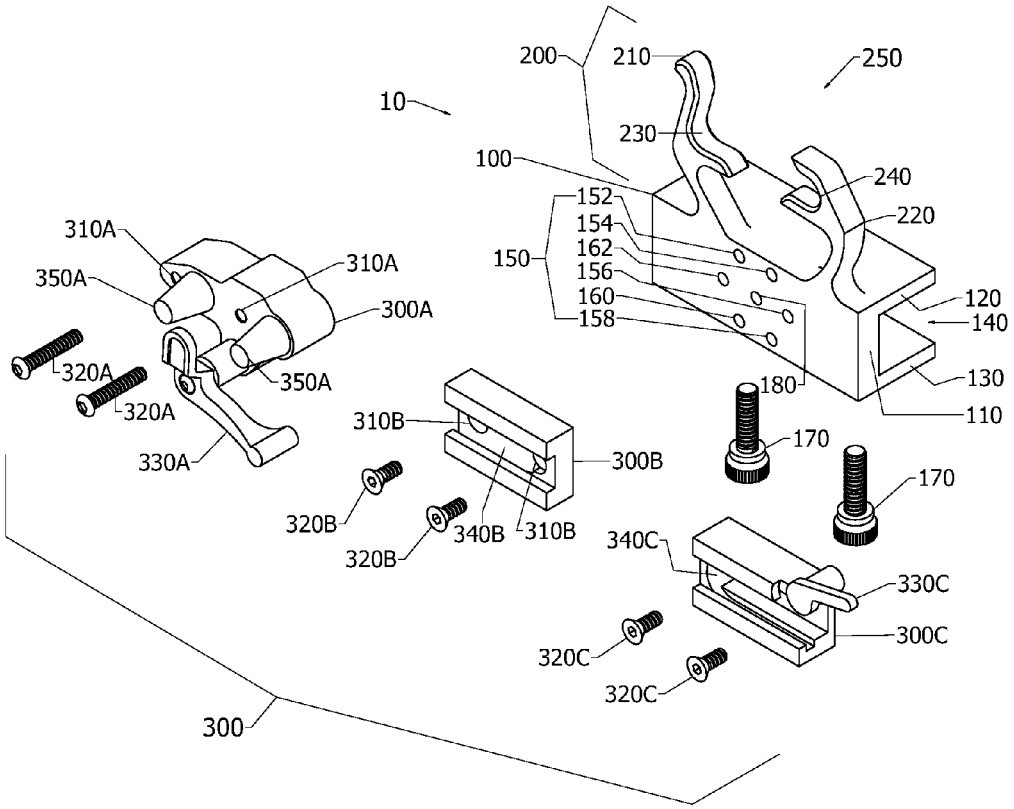
FIG. 1 is an exploded view of an exemplary quiver mount 10 with three alternative quiver brackets 300A, 300B, and 300C that can be affixed to a mounting body 100.

Returning to FIG. 1, body upper and lower flanges 120, 130 extend perpendicularly from opposing top and bottom ends of the mounting body base 110 to form a u-shaped mounting body 100. The mounting body valley 140 defined by the body flanges of the mounting body 100 removably receives a standard tree stand limb 20 (see FIGS. 3A and 3B). Two threaded members 170 are screwed into a pair of threaded member apertures 190 (see FIG. 4B) formed in the body lower flange 130, entering the mounting body valley 140 in a direction that is perpendicular to a long axis of the mounting body valley 140. The tree stand limb 20 may be sandwiched between the threaded members 170 and the body upper flange 120 to secure the mounting body 100 to the tree stand. The tree stand limb 20 may include apertures formed therein (not pictured) for receiving the threaded members 170 therein, helping attach the limb to the mounting body 100. It is noted that the threaded members 170 can be made of a more malleable material (such as neoprene) than the material of the mounting body 100 (which can be made using stronger metals and metal alloys), to enhance the longevity of the more costly mounting body 100 relative to the less costly threaded members 170.

The circular quiver bracket mounting apertures 150 extend from opposing front and back surfaces of the mounting body base 110, each aperture 150 having a diameter of substantially 0.1875 inches. The first through sixth quiver bracket mounting apertures 150 are spaced about the circular path orbiting the central axis such that three pairs of apertures are distanced by a standard aperture spacing commonly used to mount quivers and sights. Here, the first 152 and fourth 158, the second 154 and fifth 160, and the third 156 and sixth 162 mounting apertures are spaced substantially 1.3125 inches from each other. Quiver brackets 300A, 300B, 300C can be secured to the mounting body base 110 via bracket apertures 310A and 310B (with no bracket apertures being visible in the right-hand quiver bracket 300C as shown in FIG. 1), which are also spaced 1.3125 inches from each other. A pair of bracket fasteners 320A, 320B, 320C may be inserted through the bracket apertures and screwed into one of the three pairs of quiver bracket mounting apertures 150 to affix the quiver bracket 300A, 300B, 300C to the mounting body 100.

Referring again to FIG. 1, a variety of quiver brackets 300 having suitably-spaced bracket apertures 310A and 310B (with no bracket apertures being visible in the right-hand quiver bracket 300C) can be engaged to the mounting body 100. Different quiver brackets 300 are able to receive differently-configured portions of quivers 3000 which are complementary with the quiver bracket 300. For example, the right-hand quiver bracket 300C (manufactured by Bohning Archery, Lake City, Mich., USA) and the middle quiver bracket 300B each include a quiver bracket channel 340B, 340C in which an elongated portion 3010 of a quiver 3000 can be inserted (see FIGS. 3A and 3B). The left-hand quiver bracket 300A (manufactured by Alpine Archery, Lewiston, Id., USA) includes quiver bracket protrusions 350A for receiving recessed portions of a quiver (not pictured) which are complementary to the quiver bracket protrusions 350A. Each of the right-hand and left-hand quiver brackets 300A, 300C also includes quiver release lever 330A, 330C hinged with respect to the quiver bracket 300A, 300C. The quiver release levers 330A, 330C are able to sandwich portions of the quiver (such as quiver 3000) with portions of the quiver bracket 300A, 300C to releasably secure the quiver to the quiver bracket 300A, 300C.

Returning to FIGS. 2A and 2B, the quiver gripping mouth 250 formed by the first and second quiver gripping arms 210, 220 are complementary to knobs 2010, 2020 of an arrow quiver 2000 manufactured by Mathews Inc., Sparta, Wis., USA. To install the quiver 2000 between the quiver gripping arms 210, 220, a second knob 2020 of the quiver 2000 is initially inserted into the depression 240 of the second quiver gripping arm 220, which receives the second knob 2020 and limits its movement. Using the second knob 2020 as a pivot point, the first knob 2010 is rotated with respect to the second knob 2020 and swung down toward the depression 230 of the first quiver gripping arm 210. The first quiver gripping arm 210 is shaped to receive the first knob 2010, guiding it to the depression's 230 trough as the user rotates the quiver 2000 until the axis between knobs 2010, 2020 is aligned with the long axis of the mounting body valley 140.

Figure 4A:
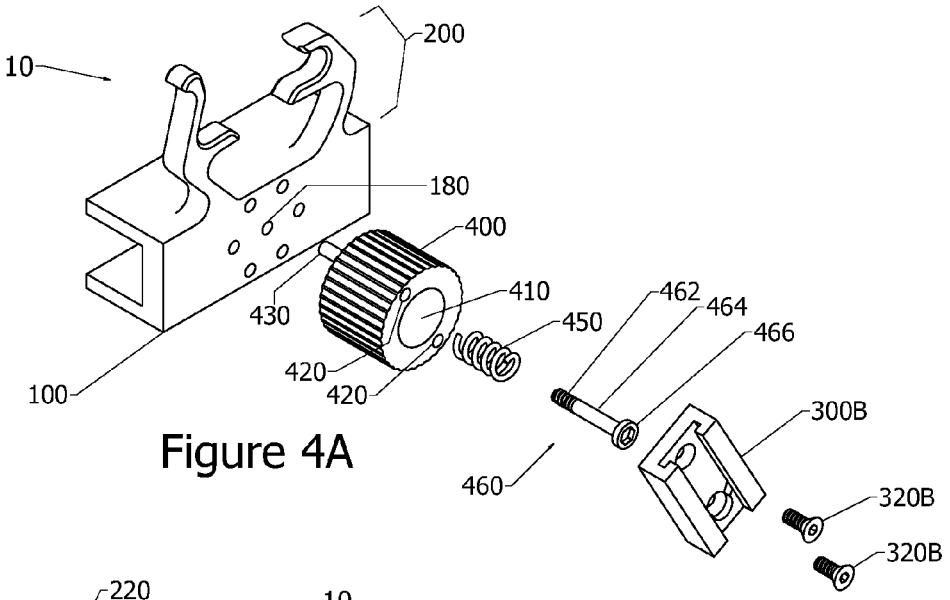
FIG. 4A is an exploded view of the quiver mount 10 and the quiver bracket 300B of FIG. 1, with a quiver bracket mount 400 therebetween.
Figure 4B:
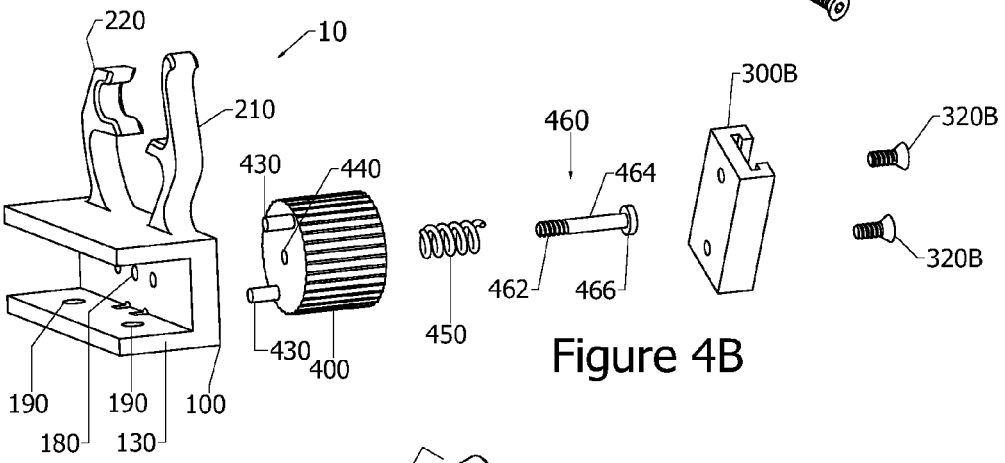
FIG. 4B is an exploded view of the components of FIG. 4A from an alternative perspective, showing threaded member apertures 190 in the body lower flange 130 of the mounting body 100.
Figure 4C:
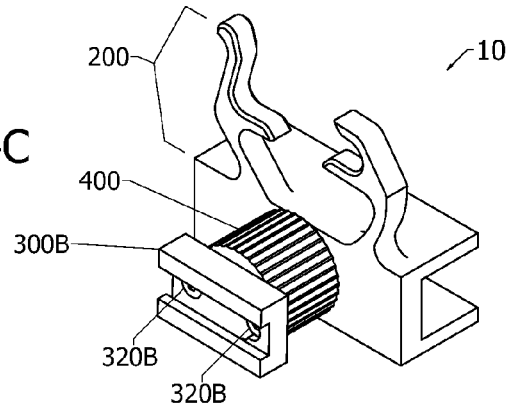
FIG. 4C shows the quiver bracket 300B and quiver bracket mount 400 of FIGS. 4A and 4B assembled such that the quiver bracket 300B is rotatable with respect to the mounting body 100 by pulling the bracket mount 400 away from the mounting body 100, rotating the bracket mount 400, and returning the bracket mount 400 to its position adjacent to the mounting body base 110.

Returning to FIGS. 4A, 4B, and 4C, the quiver bracket mount 400 allows the quiver bracket 300 to be rotatable with respect to the mounting body base 110 without the need to unscrew and rescrew bracket fasteners 320A, 320B, 320C each time the user wishes to rotate the quiver 3000 installed in the quiver bracket 300. The quiver bracket mount 400 includes a pair of bracket mount apertures 420 on opposing sides of a bracket mount recess 410, with the bracket mount apertures 420 having the same spacing as the bracket apertures 310B of the quiver bracket 300B (here, 1.3125 inches). The bracket fasteners 320B are inserted through the bracket apertures 310B and screwed into the bracket mount apertures 420 to secure the quiver bracket 300B to the quiver bracket mount 400 (as shown in FIG. 4C). Once the quiver bracket 300B has been fastened to the quiver bracket mount 400 using the bracket fasteners 320B, the quiver bracket 300B does not need to be unscrewed unless the user wishes to affix a different quiver bracket 300 to the quiver bracket mount 400, or wishes to affix the quiver bracket 300B to the mounting body 100 directly. The quiver bracket mount 400 thus serves as a rotatable intermediary between the quiver bracket 300 and the mounting body 100.

To install the quiver bracket mount 400 on the mounting body 100, the locking members 430 are removably inserted into any pair of quiver bracket mounting apertures 150 (preferably, one of the pairs of quiver bracket mounting apertures 150 having the same spacing as the bracket apertures 310B). The compressible bracket mount spring 450 is inserted into the bracket mount recess 410, and down to the bottom of the bracket mount recess 410, with a spring long axis that is aligned with an axis along which the locking members 430 enter the quiver bracket mounting apertures 150. A bracket mount connector 460 is inserted through a central axis of the bracket mount spring 450 and extended through a bracket mount connector aperture 440 formed between the locking members 430 of the quiver bracket mount 400. The bracket mount connector 460 has a threaded portion 462 at its insertion end, and the threaded portion 462 is screwed into a mounting body connector aperture 180 located at the center of the circular path of the quiver bracket mounting apertures 150. A bracket mount connector head 466 (which is separated from the threaded portion 462 by an unthreaded connector body portion 464) fully enters the bracket mount recess 410 and contacts the bracket mount spring 450 when the bracket mount connector 460 is fully screwed into the bracket mount connector aperture 440. The bracket mount spring 450 resists being compressed between the bracket mount connector head 466 and the bottom of the bracket mount recess 410 (as occurs when the quiver bracket mount 400 is pulled away from the mounting body base 110), biasing the quiver bracket mount 400 toward the mounting body base 110.

To rotate the quiver bracket mount 400, the user pulls the quiver bracket mount 400 away from the mounting body base 110, retracting the locking members 430 from the quiver bracket mounting apertures 150 in which they were inserted and bringing the quiver bracket mount 400 to the rotatable position. The locking members 430 resist being retracted from the mounting body 100 apertures due to the biasing provided by the bracket mount spring 450. Thus, the bracket mount spring 450 must be compressible by a distance equal to or greater than the length of the locking members 430 for the quiver bracket mount 400 to be fully retractable from the quiver bracket mounting apertures 150. The user then rotates the retracted quiver bracket mount 400 in a clockwise or counterclockwise direction as desired, and inserts the locking members 430 into a different pair of mounting body 100 apertures, releasing the quiver bracket mount 400 in its new angular position and returning it to the fixed position. Increasing the number of pairs of mounting body 100 apertures formed in the mounting body base 110 decreases the minimum angular rotation with each turn of the quiver mount 10.

It must be kept in mind that the quiver mount 10 shown in the accompanying drawings and discussed above are merely exemplary, and may have a variety of different configurations that allow it to engage with a wide variety of accessories and structures different from those noted. For example, referring to FIG. 1, the mounting body base 110 and mounting body flanges 120, 130 need not form the u-shape depicted in the figures. The mounting body 100 may instead form a mounting body valley 140 having a configuration that is complementary to any structure to which the mounting body 100 is to be engaged. By providing rounded and flexibly resilient mounting body flanges 120, 130, for example, threaded members 170 may not be necessary to secure the mounting body 100 to a bar inserted into the mounting body valley 140.

Figure 2A:
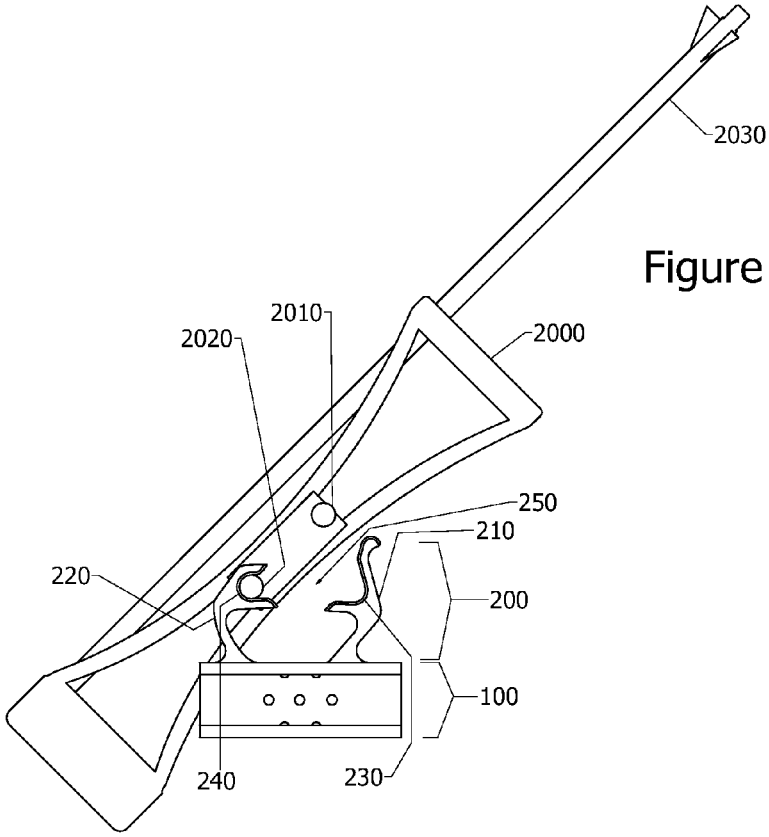
FIG. 2A shows a quiver 2000 (releasably holding arrow 2030) partially installed in the quiver gripping mouth 250 of the quiver gripping arms 200 of the quiver mount 10 of FIG. 1.
Figure 2B:
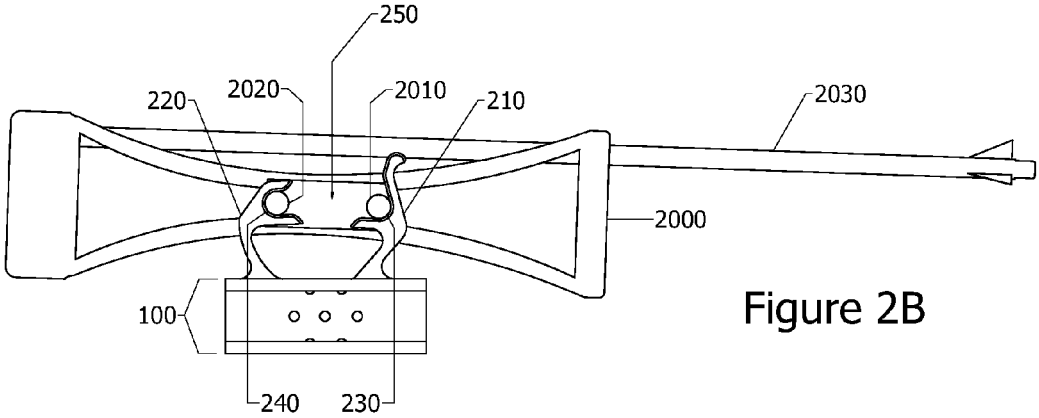
FIG. 2B shows the quiver 2000 of FIG. 2A fully installed in the quiver gripping arms 200 of the quiver mount 10 of FIG. 2A.

Referring to FIGS. 2A and 2B, the quiver gripping arms 200 shown in the figures are complementary with an arrow quiver 2000 of a particular manufacturer (Mathews Inc). They may be replaced, however, by any structure having "male" or "female" portions suited to removably secure any accessory to the mounting body 100, or to secure the mounting body 100 to any anchoring structure. For example, by replacing the arms with hooks or loops, the mounting body 100 can be secured to a wide variety of other components (directly, or indirectly through, e.g., a carabiner or strap). Additionally, replacing the arms with a mechanism by which the mounting body 100 can be anchored to complementary structures (other than tree stands) would allow the mounting body 100 to be rigidly mounted in a greater variety of locations and settings.

Returning to FIG. 1, although the mounting body base 110 is depicted with (female) apertures which are able to receive quiver brackets 300 secured via bracket fasteners 320A, 320B, 320C, the mounting body 100 apertures can be replaced by (male) protruding members able to engage quiver brackets 300 or other accessories. Such protruding members may be spaced and oriented like the quiver bracket mounting apertures 150, or they may have other configurations suited to other bow-hunting accessories with complementarily-shaped (female) apertures. Additionally, a quiver may be configured to be engaged to the mounting body 100 directly, without the quiver bracket 300 as intermediary. For example, a quiver may have male protrusions or female apertures for interaction with female apertures (such as the quiver bracket mounting apertures 150) or male protrusions, respectively, formed in the mounting body 100.

Figure 3A:
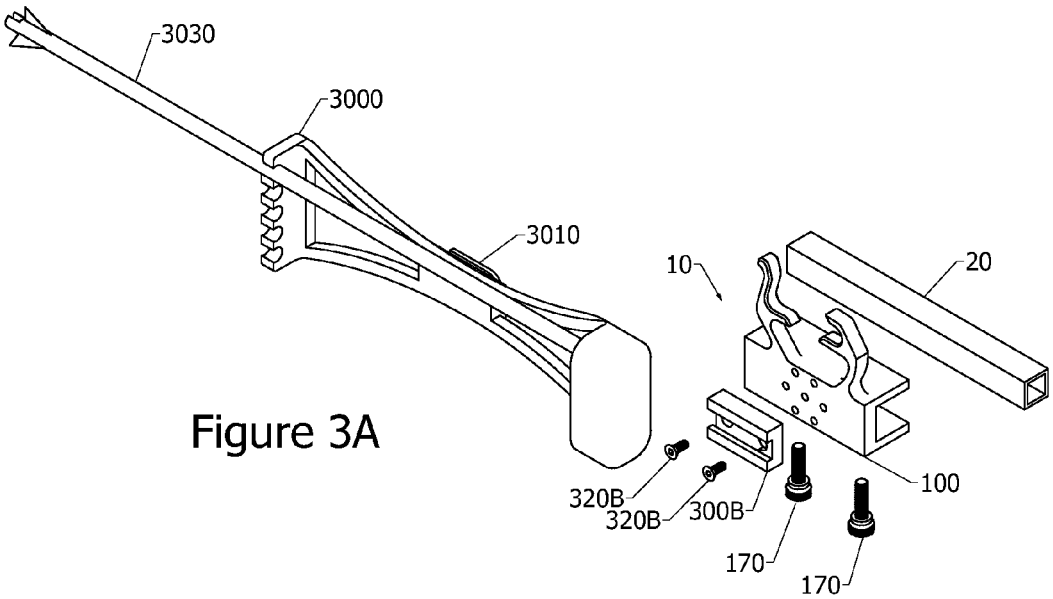
FIG. 3A is an exploded view of the quiver mount 10 of FIG. 1 in combination with a quiver 3000 (releasably holding arrow 3030), a tree stand limb 20, and the quiver bracket 300B of FIG. 1, with the quiver 3000 removably installable in the quiver bracket 300B, and the limb 20 having dimensions that are complementary to those of the mounting body valley 140 of the quiver mount 10.
Figure 3B:
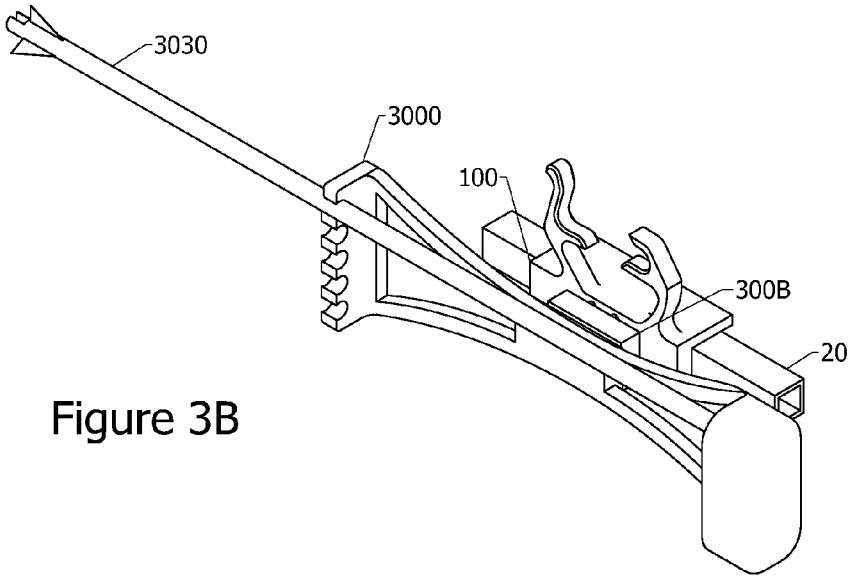
FIG. 3B shows the quiver 3000 of FIG. 3A installed in the quiver bracket 300B of FIG. 3A, with the quiver bracket 300B affixed to the mounting body 100, and the tree stand limb 20 of FIG. 3A inserted within the mounting body valley 140 of FIG. 3A.

Referring to FIGS. 1, 3A, and 3B, the mounting body 100 can be configured to be securable to a tree or other structure independent of the mounting body valley 140 and the mounting body flanges 120, 130. For example, the mounting body 100 may include two elongated slits/openings formed in the mounting body base 110 on opposing sides of the array of quiver bracket mounting apertures 150. This would allow a strap to be inserted through one of the slits and into the mounting body valley 140 from the front of the mounting body base 110 toward the back of the mounting body base 110. In the mounting body valley 140, the strap could extend to the opposing slit and back through the opposing slit to the front of the mounting body base 110. Opposing ends of the strap could then be wrapped around or otherwise secured to a structure (such as a tree). Positioning the slits on opposing sides of the array of quiver bracket mounting apertures 150 enhances stability when the mounting body 100 is anchored, and allows the strap to stay out of the way of the quiver bracket 300 and/or quiver bracket mount 400 affixed to the mounting body 100.

It should also be understood that various terms referring to orientation and position are used throughout this document—for example, "top" and "bottom" (as in "opposing top and bottom ends of the mounting body base") and "upper and lower" (as in "body upper and lower flanges")—are relative terms rather than absolute ones. In other words, it should be understood (for example) that the mounting body and the parts thereof may be reoriented without affecting its overall structure. Thus, such terms should be regarded as words of convenience, rather than limiting terms. Also, it is to be understood that such terms as "forward," "rearward," "left," "right," "upwardly," "downwardly," and the like are words of convenience and are not to be construed as limiting terms.

Various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

Although the quiver gripping arms are shown extending upwards from the body upper flange, the arms can instead extend outward from the mounting body base 110 or downward from the body lower flange 130. Analogously, the quiver bracket mounting apertures 150 and the threaded member apertures 190 in the mounting body base 110 and the body lower flange 130, respectively, may instead be formed in other suitable locations on the mounting body 100.

The mounting body 100 depicted in the figures includes six quiver bracket mounting apertures 150 configured in a circular array about a central axis. The mounting body 100, however, may have any number of quiver bracket mounting apertures 150, suitably arranged for receiving various accessories to be mounted to the quiver mount 10.

Although the quiver bracket mounting apertures 150 within each pair are described as being spaced 1 and 5/16 inches apart, the apertures in each pair may have any spacing suitable to the accessories with which the mounting body 100 is to interact.

Also, any of various components, such as threaded members 170, bracket fasteners 320A, 320B, 320C, quiver bracket mount 400, bracket mount spring 450, bracket mount connector 460, etc., may be replaced with any desired fastening, securing, biasing, or rotating mechanism that is suitable.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A quiver mount including:

a) a mounting body having a mounting body base with spaced mounting body flanges extending therefrom, with a mounting body valley being defined between the mounting body flanges;

b) a pair of threaded member apertures formed in one of the mounting body flanges, the threaded member apertures configured to receive a pair of threaded members extending through the mounting body flange and into the mounting body valley;

c) a pair of quiver gripping arms extending from the mounting body, the quiver gripping arms being configured to secure a quiver therebetween; and d) an array of quiver bracket mounting apertures defined in the mounting body base, wherein the quiver bracket mounting apertures within the array are:

1) situated along a path orbiting a central axis, and 2) equidistant from the central axis.

2. The quiver mount of claim 1 wherein:

a) each of the quiver gripping arms of the pair of quiver gripping arms has a depression formed therein, and b) the quiver gripping arms first converge and then diverge as the quiver gripping arms extend toward the mounting body.

3. The quiver mount of claim 1 further including a quiver bracket secured to the mounting body base, the quiver bracket being configured to removably secure a quiver to the mounting body.

4. The quiver mount of claim 3 further including a quiver bracket mount situated between the mounting body base and the quiver bracket, the quiver bracket mount being rotatable with respect to the central axis of the array of quiver bracket mounting apertures.

5. The quiver mount of claim 4 wherein the quiver bracket mount is translatable between:

a) a fixed position in which the quiver bracket mount is closely adjacent to, and non-rotatably fixed to, the mounting body base, and b) a rotatable position in which the quiver bracket mount is:

1) spaced from the mounting body base, and 2) rotatable with respect to the mounting body base.

6. The quiver mount of claim 5 wherein the quiver bracket mount is elastically biased toward the mounting body base by a compressible bracket mount spring.

7. The quiver mount of claim 5 wherein the array is defined by pairs of the quiver bracket mounting apertures, the quiver bracket mounting apertures in each pair being spaced at least substantially 1 and 5/16 inches apart.

8. The quiver mount of claim 3 wherein the quiver bracket has a quiver release lever movable between:

a) a closed position in which a quiver is secured to the quiver bracket, and b) an open position in which a quiver is separable from the quiver bracket.

9. The quiver mount of claim 1 wherein:

a) the quiver gripping arms each have a depression formed therein b) each quiver gripping arm's depression faces toward the other of the quiver gripping arms, c) an axis extending from and bisecting the depression of one of the quiver gripping arms is oriented at an angle of at least 30 degrees to an axis extending from and bisecting the depression of the other of the quiver gripping arms.

10. The quiver mount of claim 1 further including a quiver bracket mount:

a) having a locking member receivable within the quiver bracket mounting apertures, wherein:

a) being rotatably affixed to the mounting body, whereby the quiver bracket mount may be rotated with respect to the mounting body to fit the locking member within different ones of the quiver bracket mounting apertures.

11. The quiver mount of claim 10 wherein the quiver bracket mount is elastically biased toward the mounting body.

12. A quiver mount including:

a) a mounting body having spaced mounting body flanges with a mounting body valley being defined therebetween;

b) a threaded member extending through a threaded member aperture formed in the mounting body, the threaded member being configured to be installable into the mounting body valley to secure a limb of a tree stand within the mounting body valley;

c) first and second spaced quiver gripping arms extending from the mounting body, the quiver gripping arms each having a depression formed therein with a depression facing toward the other of the quiver gripping arms, wherein an axis extending from and bisecting the depression of the second quiver gripping arm is oriented at an angle of at least 30 degrees to an axis extending from and bisecting the depression of the first quiver gripping arm; and d) an array of quiver bracket mounting apertures defined in the mounting body, wherein the array is defined by pairs of quiver bracket mounting apertures, each pair having the same distance between the quiver bracket mounting apertures therein.

13. The quiver mount of claim 12 further including a quiver bracket secured to the mounting body, the quiver bracket being configured to secure a quiver to the mounting body.

14. The quiver mount of claim 13 further including a quiver bracket mount positioned between the mounting body and the quiver bracket, wherein the quiver bracket mount is rotatable with respect to the mounting body such that the quiver bracket rotates with the quiver bracket mount.

15. The quiver mount of claim 14 wherein:

a) the quiver bracket mount includes a pair of locking members receivable within one of the pairs of quiver bracket mounting apertures, and b) the quiver bracket mount is elastically biased toward the mounting body such that the quiver bracket mount is movable between:

1) a rotatable position in which the pair of locking members are retracted from the quiver bracket mounting apertures such that the quiver bracket mount is rotatable with respect to the mounting body, and 2) a fixed position in which the pair of locking members are fit within one of the pairs of quiver bracket mounting apertures.

16. The quiver mount of claim 15 wherein:

a) the depression of the first quiver gripping arm is smaller than the depression of the second quiver gripping arm, and b) the quiver gripping arms define a quiver gripping mouth therebetween, the quiver gripping mouth first converging and then diverging as the quiver gripping arms extend toward the mounting body.

17. The quiver mount of claim 13 wherein the quiver bracket has a quiver release lever movable between:

a) a closed position in which a quiver is secured to the quiver bracket, and b) an open position in which a quiver is separable from the quiver bracket.

18. The quiver mount of claim 12 wherein the array of quiver bracket mounting apertures is defined by pairs of the quiver bracket mounting apertures, the quiver bracket mounting apertures in each pair being spaced at least substantially 1 and 5/16 inches apart.

19. The quiver mount of claim 12 further including a quiver bracket mount rotatably affixed to the mounting body, wherein the quiver bracket mount:

a) has a pair of locking members receivable within one of the pairs of quiver bracket mounting apertures, and b) is rotatable with respect to the mounting body to fit the pair of locking members within different ones of the pairs of quiver bracket mounting apertures.

20. The quiver mount of claim 19 wherein the quiver bracket mount is elastically biased toward the mounting body.

* * * * *